United States Patent [19]

Nishikawa et al.

[11] Patent Number: 4,756,684

[45] Date of Patent: Jul. 12, 1988

[54] COMBUSTION MONITOR METHOD FOR MULTI-BURNER BOILER

[75] Inventors: Mitsuyo Nishikawa; Tooru Kimura, both of Hitachi; Akira Fukuhara, Yokohama, all of Japan

[73] Assignee: Hitachi, Ltd., Tokyo, Japan

[21] Appl. No.: 36,483

[22] Filed: Apr. 9, 1987

[30] Foreign Application Priority Data

Apr. 9, 1986 [JP] Japan ..... 61-79945

[51] Int. Cl.[4] ..... F23N 5/08

[52] U.S. Cl. ..... 431/79; 431/175; 110/185

[58] Field of Search ..... 431/75-79, 431/13, 175; 110/261-265, 185; 250/554, 372; 340/577, 578

[56] References Cited

U.S. PATENT DOCUMENTS 4,368,031 1/1983 Chadshay ..... 431/79
4,620,491 11/1986 Nishikawa et al. ..... 431/79
4,622,922 11/1986 Mayagaki et al. ..... 110/185

FOREIGN PATENT DOCUMENTS 169015 9/1985 Japan ..... 431/79
263014 12/1985 Japan ..... 431/79

OTHER PUBLICATIONS

Kurihara et al., "A Combustion Diagnosis Method for Pulverized Coal Boilers Using Flame-Image Recognition Technology", IEEE 1985.

*Primary Examiner*—James C. Yeung
*Attorney, Agent, or Firm*—Antonelli, Terry & Wands

[57] ABSTRACT

A monitor method for the combustion conditions in a furnace of a boiler having a plurality of burners is disclosed. The method includes the steps of detecting the flame intensity at a predetermined position of a flame, by using an optical fiber having as its view the predetermined position at the flame of each of the plurality of burners; judging if the combustion conditions of each burner are normal or not, based on if the flame intensity detected for each burner flame is within a predetermined normal level range; and displaying the judgement results. Preferably, an image fiber for obtaining a flame image indicating the combustion conditions is provided for at least one of the burners, and the normal level range is determined based on the flame image obtained by the image fiber.

5 Claims, 7 Drawing Sheets

COMBUSTION MONITOR METHOD FOR MULTI-BURNER BOILER

BACKGROUND OF THE INVENTION

The present invention relates to a monitor apparatus for a boiler and to a combustion monitor method suitable for a multi-burner boiler of a large size such as installed at a thermal power plant.

As a device used in a conventional method for monitoring combustion conditions of a boiler, there are known, as shown in FIG. 1, (1) a flame detector mounted at a burner nozzle for detecting a flame, (2) a detector mounted at an exhaust gas outlet or in a flyash conduit for detecting components contained in an exhaust gas, (3) an ITV camera having an explosion-proof structure and mounted at the upper portion of a furnace for obtaining information on the furnace, and so on. The device (1) detects the light-up and light-down of a burner. The device (2) is provided for detecting the exhaust gas components (particularly, such as nitrogen oxides $NO_X$ and unburnt content) to monitor if they excess a limit stipulated by environment regulations. The ITV camera (3) takes photographs of the internal of a furnace to help an operator grasp the combustion conditions.

Such conventional devices mounted at a boiler can achieve respective objectives. However, they are not always sufficient for monitoring a multi-burner boiler as a whole.

Particularly, the flame detector (1), which detects the "light-up" and "light-down" of a flame at the outlet of the burner, may issue an erroneous judgement of "light-down" if a flame is being lifted from the burner nozzle. The operator has been charged with a final decision for such a case. This is because the flame detector basically operates to outlet light-up (ON) and light-down (OFF) signals of a flame only at the outlet of the burner.

The detector (2) for exhaust gas components takes several ten seconds to several minutes in analyzing the exhaust gas (or several times to several days in case of unburnt components in flyash). Since the components are not obtained on a real time basis, the analyzed values can be used only as a reference in estimating the combustion conditions in a furnace.

The ITV camera (3) mounted at the upper portion of a furnace takes photographs of a flame emitted from the burner located opposite to the camera. Since the flame is photographed while it is swirling, the operator must decide the combustion conditions based on experience and intuition. In addition, the ITV camera must be mounted essentially with an explosion-proof structure for safety purpose, resulting in a troublesome work of its maintenance and the like.

To solve the above problems, a combustion control method has recently been developed wherein a furnace is monitored using an image fiber, as disclosed, for example, in U.S. Pat. No. 4,622,922 issued Nov. 18, 1986 and "A COMBUSTION DIAGNOSIS METHOD FOR PULVERIZED COAL BOILERS USING FLAME-IMAGE RECOGNITION TECHNOLOGY" in IEEE 1985. However, if this method is applied to a multi-burner boiler, it becomes necessary to mount an image fiber and a water cooling tube to all the burners, resulting in very high cost and unpractical approach.

SUMMARY OF THE INVENTION

It is an object of the present invention to provide a method and apparatus applicable to monitoring the combustion conditions of a multi-burner boiler.

According to the present invention, the above object can be achieved by providing an optical fiber for each of a plurality of burners, the optical fiber being located have a specific position or area of a corresponding burner flame as its view, and providing a display device which displays as to whether the light intensity of a flame detected by each optical fiber is within a predetermined range, i.e., between predetermined upper and lower limits, or higher than a predetermined level, to thereby monitor the fuel combustion conditions of each burner.

According to a preferred embodiment of the present invention, an image fiber is provided for at least one of the plurality of burners, and a flame image obtained by at least one image fiber is displayed to decide the fuel combustion conditions at the burner. The fuel combustion conditions at the other burners are judged based on a comparison between the light intensity of the flame of each of the other burners detected by the optical fiber mounted for the associated burner and the flame image obtained by the image fiber.

DESCRIPTION OF THE PREFERRED EMBODIMENTS

The description will be given for a case where the present invention is applied to a large size boiler at a thermal power plant, particularly to a pulverized coal boiler. A fuel supply system of a pulverized coal burner is constructed of a plurality of mills and a plurality of burners to which pulverized coal from each mill is supplied. Each mill is driven in accordance with a load and a fuel supply to each burner is controlled in units of each mill. The boiler is mounted with a plurality of burners, each burner is requested to combust fuel at a most suitable condition. Namely, since the fuel combustion by a burner is controlled by an air quantity relative to supplied fuel, in case of air-rich conditions although it becomes economical due to decrease of unburnt content of fuel, a problem of pollution arises due to increase of $NO_X$. On the other hand, in case of fuel-rich conditions although $NO_X$ reduces, it becomes uneconomical due to increase of unburnt content of fuel. Thus, it is necessary to perform combustion at a proper air quantity. Since each burner has its own specific combustion conditions, even of one burner performs combustion at a most suitable condition, all the other burners do not always perform combustion at a most suitable condition. Therefore, a prerequisite of this invention is that every burner is provided with something serving as a monitor to independently monitor it. According to a most simple structure of this invention, an optical fiber is provided for each burner, having a predetermined position or area of a burner flame as its view, and a display device is provided which displays as to whether the light intensity of a flame of each burner detected by the optical fiber is within a predetermined range or not, to thereby monitor the combustion conditions of all the burners.

According to a preferred embodiment, considering that the fuel supply to the burner is controlled in units of each mill as described previously, an image fiber is provided in place of or in parallel with one burner among a plurality of burners which are supplied fuel from a same mill. Whether the light intensity of the flame of each burner detected by the optical fiber indicates a most suitable condition, is determined based on a comparison of the image of the flame detected by the optical fiber with the flame image detected by the image fiber to thereby monitor the combustion conditions of all the burners more correctly. Therefore, the present invention enables to monitor a multi-burner economically without using plural expensive image fibers.

Figure 1:
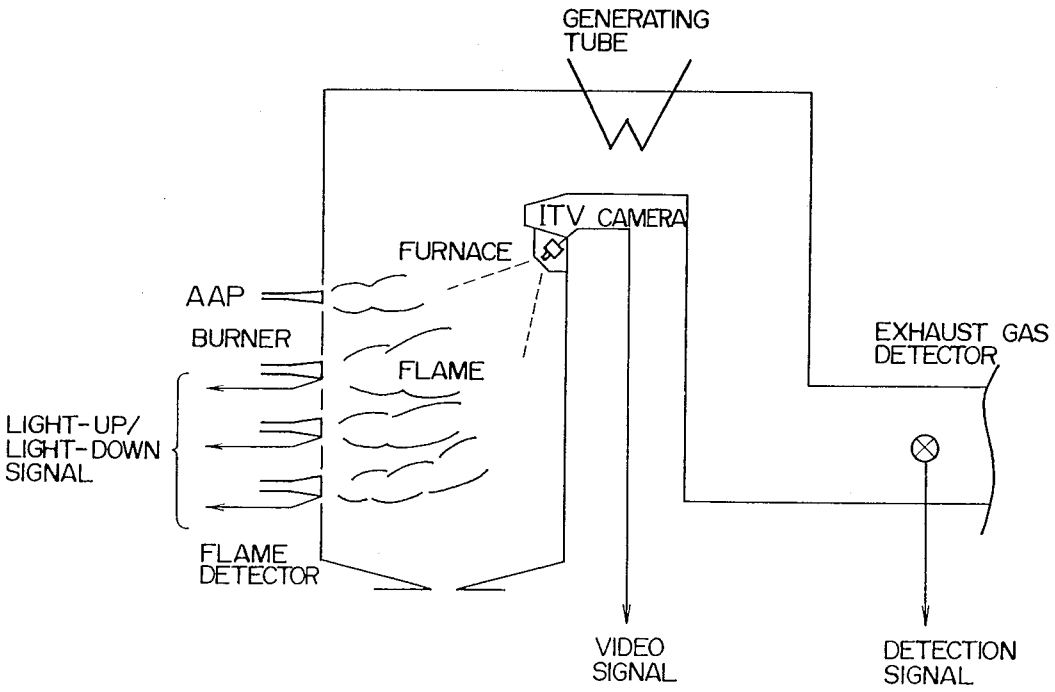
FIG. 1 (PRIOR ART)
FIG. 1 is a schematic view illustrating an example of a conventional monitor apparatus.
Figure 2:
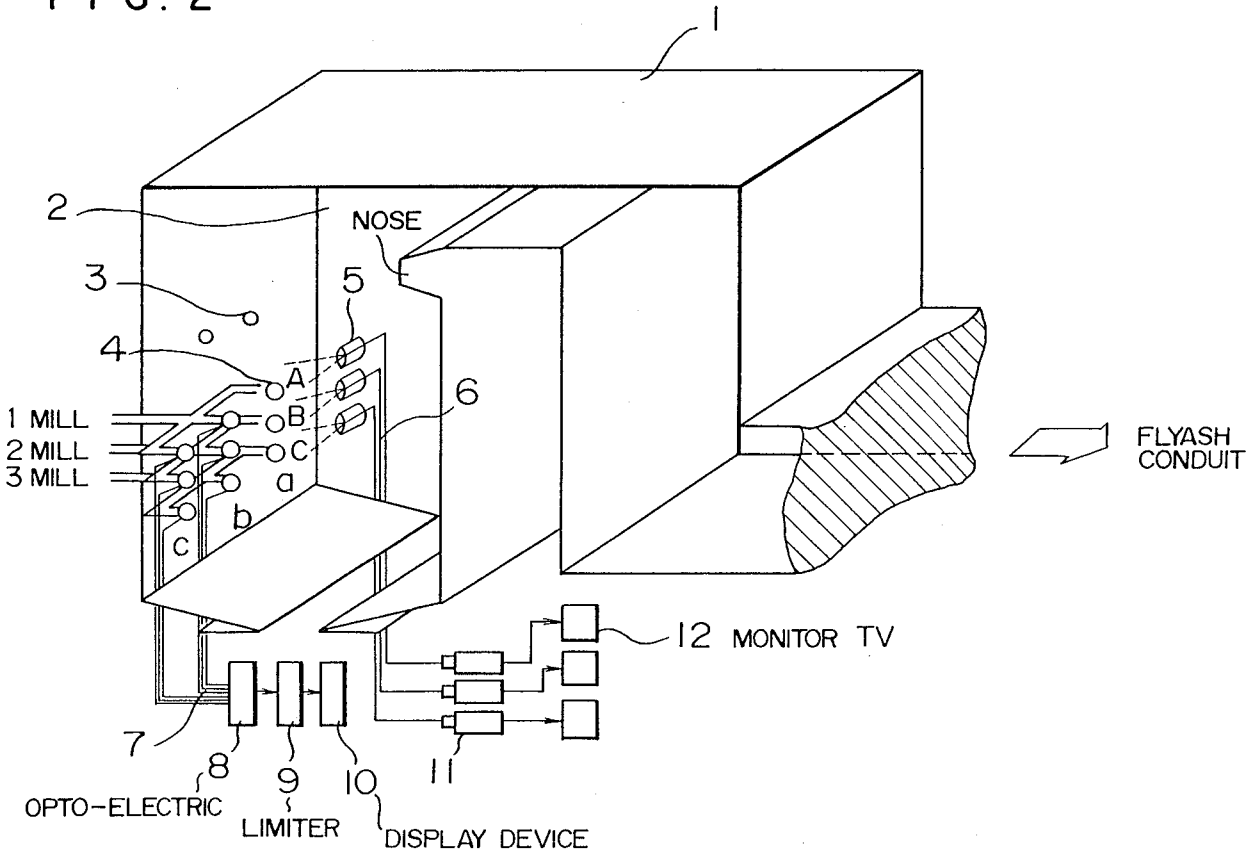
FIG. 2 shows the structure of an embodiment according to the present invention.

An embodiment of the present invention will be described with reference to FIG. 2. FIG. 2 is a schematic illustration wherein the invention is applied to a pulverized coal boiler 1. The burner is constructed of 3 stages A, B and C and 3 columns a, b and c, and a different fuel supply mill is used for each stage.

Image fibers 6 measure flames of burners As, Ba and Ca, while the light intensity of the flames of the other burners are detected by optical fibers 7. Particularly, a flame of one of the burners whose fuel is supplied from a same mill is measured by an image fiber, while the flames of the other burners are measured by optical fibers, thus constituting a flame measuring unit for the multi-burner boiler.

In FIG. 2, reference numeral 2 represents a furnace, 3 an after-air port, 4 a burner outlet, 5 a cooling device, 8 an opto-electric transducer, 9 a limiter, 10 a display device, 11 an ITV camera, and 12 a monitor TV.

The flames monitored by the image fibers are photographed by ITV cameras and displayed on monitor TV's, the displayed images are then monitored by an operator. The flame light-intensities at predetermined positions or areas of burners Ab and Ac of the same stage are detected by optical fibers, converted into voltages (or currents or others) corresponding to the intensities by the opto-electric transducer, and passed through a limiter limiting upper and lower limits or a lower limit, the results being display on a display device (such as LED).

Burners Bb, Bc and Cb, Cc of the other stages are constructed similarly to realize a multi-burner combustion condition monitor apparatus capable of monitoring the combustion conditions correctly.

As previously described, in a most simple structure of this invention, an optical fiber is provided for each burner without using an image fiber. In this case, the image fibers 6 shown in FIG. 2 are omitted and instead, optical fibers are provided for burners Aa, Ba and Ca. These optical fibers, similar to the other optical fibers 7, are connected to the opto-electric transducer 8 to convert the flame light-intensities detected by the fibers into electrical signals. Whether combustion conditions of each burner are normal or not is judged based on if a signal level is within a predetermined range, i.e., within predetermined upper and lower limits, or higher than a predetermined lower limit. The judged results are displayed on the display device 10. Thus, it becomes possible to monitor if all the burners are at most suitable combustion conditions.

In case where image fibers 6 are provided for burners Aa, Ba and Ca as shown in FIG. 2, the burners Aa, Ba and Ca are monitored using the flame images thereof displayed on the monitor TV's via the image fibers. The flame images can be used as a basis of judging the combustion conditions of the other burners based upon the light-intensities of the flame detected at the predetermined positions or areas thereof by the optical fibers 7, thus enabling a more correct monitoring. Particularly, by displaying the flame images of the burners concerned obtained by the image fibers on a display device 17-1 (FIG. 3), it is possible to adjust the combustion conditions of the burners at a most suitable (normal) condition. Further, by estimating a normal combustion range of flame intensities obtained by the optical fibers 7 based on the flame images, and determining threshold values to be set at the limiter based on the estimated normal combustion range, a correct monitoring can be realized.

Figure 3:
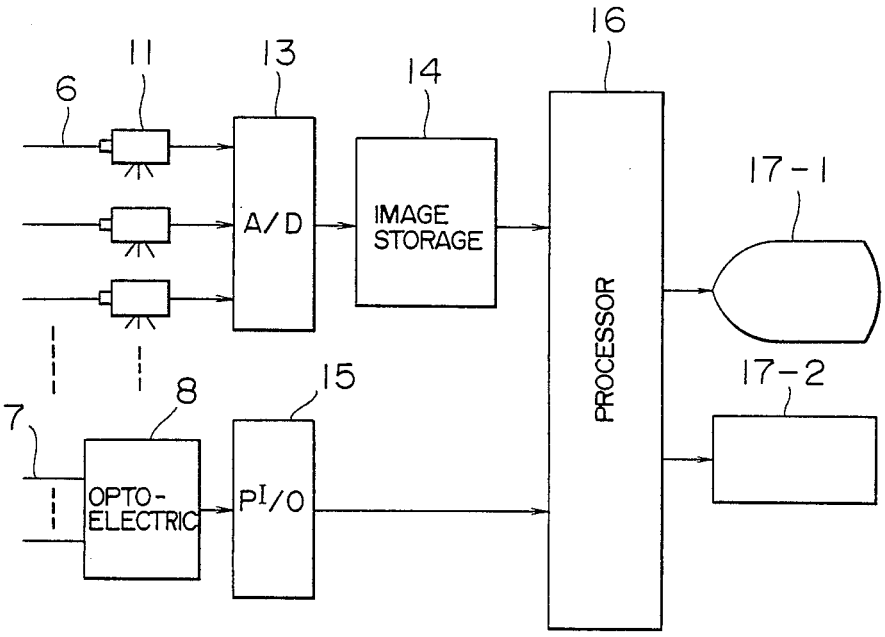
FIG. 3 is a block diagram showing a circuit arrangement of another embodiment of a processing circuit according to the present invention.

The above embodiment has been directed to the case where an operator gives a judgement through visual monitoring. This visual monitoring may automatically be carried out, an example of which is shown in FIG. 3. In the structure shown in FIG. 3, output signals from the ITV's 11 and an opto-electric transducer 8 shown in FIG. 2 are inputted to a processor 16, and the processed results are displayed on a display device 17-2.

A flame image obtained by the image fiber 6 indicates the intensity distribution of a flame, which is converted into an electrical signal by the ITV camera 11 and converted further into a digital signal by an A/D converter 13 to store the digital signal into an image storage 14 and then inputted into the processor 16. The flame image obtained by the image fiber is displayed on the display device 17-1, and the burner concerned is adjusted at a most suitable combustion condition based on the displayed image.

The light intensity of the flame detected by the optical fiber is converted into an electrical signal by the opto-electric transducer 8 and thereafter, further converted into a digital signal by a P I/O (process I/O) 15 to be inputted to the processor 16.

Figure 4A:
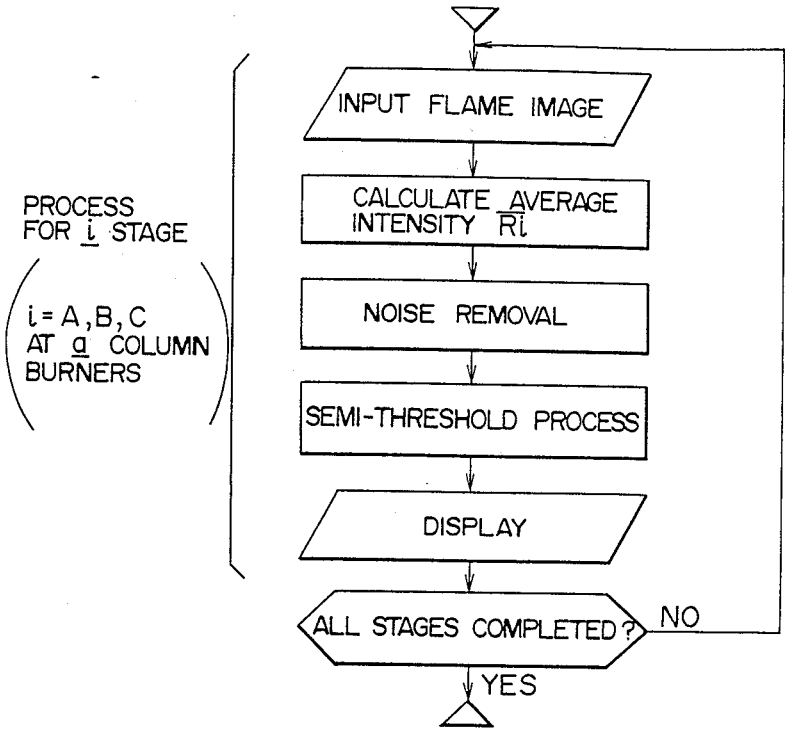
FIGS. 4A and 4B are flow charts illustrating the operation of the processing circuit shown in FIG. 3.
Figure 4B:
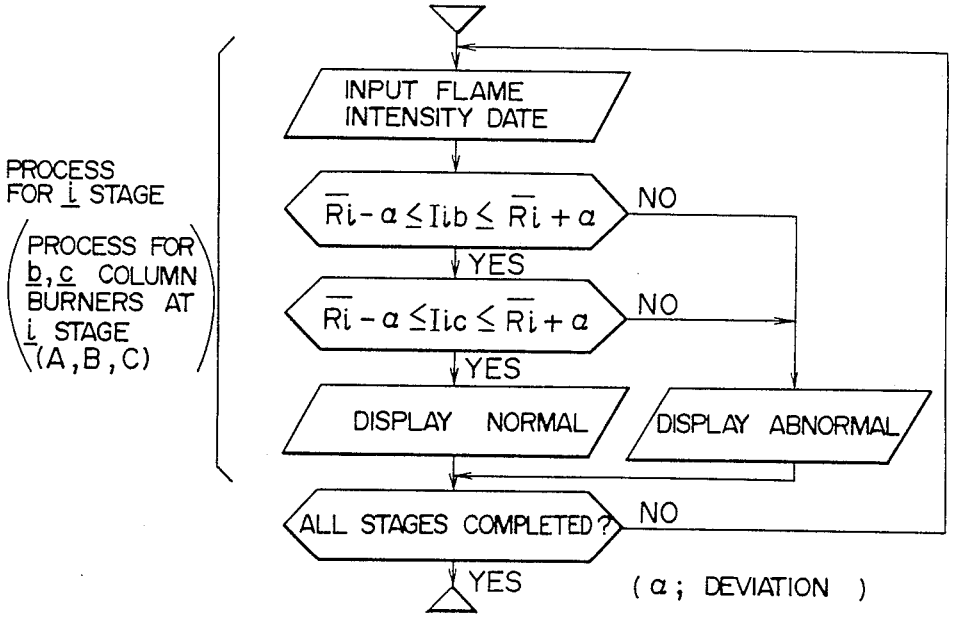

Signals inputted to the processor 16 are processed in accordance with, for example, the flow charts shown in FIGS. 4A and 4B, the processed results are displayed on the display devices to notify them to the operator.

The flow chart shown in FIG. 4A is an example of a monitor algorithm for a flame image monitored by the image fiber.

The average flame intensity at the area (or point) corresponding to a predetermined area specified by a view of the optical fiber is determined for each flame image at each stage in column a, in accordance the following equation (1).

$$\overline{R_i} = \frac{K}{X \cdot Y} \sum^{Y} \sum^{X} R_i(x, y) \quad (1)$$

Where i: stage (A, B and C),

X, Y: axes of abscissas and ordinates of a rectangular coodinate defining an image plane, x, y: positions on an X-Y coordinate, Ri (x,y): flame intensity at position (x, y), $\overline{Ri}$: average flame intensity, K: constant.

Noises in a flame image at each stage is removed. The flame image is then subjected to a semi-threshold process to obtain an area and shape of the image and display the results. The semi-threshold process means a process wherein the light intensity of half-tone image is made 0 if it is no higher than a limit value, and the light intensity is used as if it is higher than the limit value. A process of obtaining an average image of an input image, or other processes may be used in this case.

The flowchart of FIG. 4B is an example of a monitor algorithm for monitoring the light intensity of the flame detected by the optical fiber. In this example, it is judged if the flame light intensity Iib for i stage and b column, or the flame light intensity Iic for i stage and c column is within the range between values $\pm\alpha$ of the average flame light intensities obtained by the equation (1). The judged results are displayed on the display device 17-2.

In the above embodiment, as a basis for judging, based on the flame light-intensity obtained by the optical fiber, if the burner is normal or not, an average value of normal image flame light-intensities obtained by the image fiber within an area corresponding to the view of the optical fiber has been used. However, a function of flame light-intensity at a predetermined position or area of a flame image or a function of an average value of flame light intensities within a predetermined area, may be used as such a basis.

As seen from the above embodiment, the combustion conditions and running conditions of a multi-burner boiler can be monitored effectively.

Figure 5:
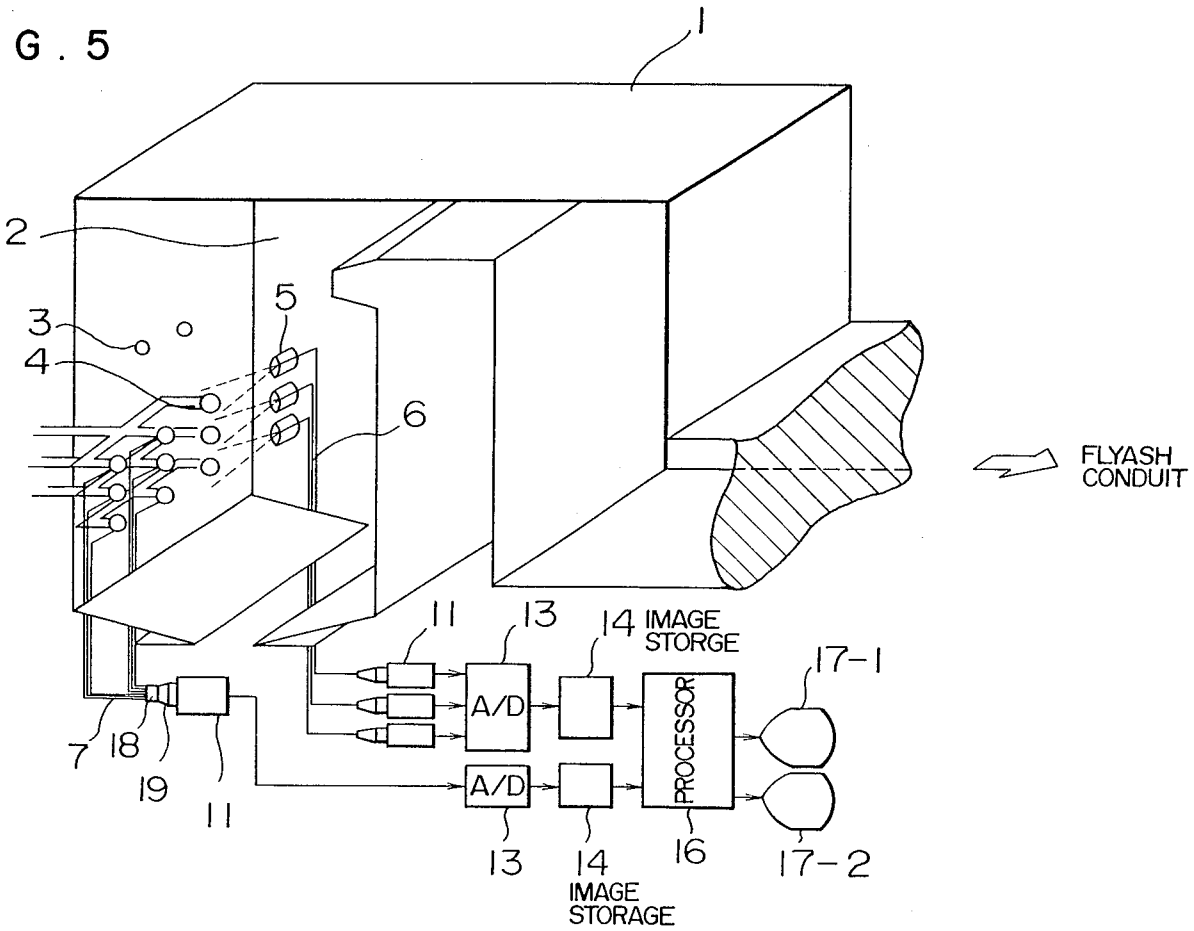
FIG. 5 shows the structure of another embodiment according to the present invention.

Another embodiment of the present invention will be described with reference to FIGS. 5, 6A and 6B. Elements in FIG. 5 same as or similar to those in FIGS. 2 and 3 have been represented using identical reference numerals. A display device 17-1 is for displaying flame images monitored by the image fibers, and a display device 17-2 will be discribed later.

In this embodiment, the combustion conditions of each burner monitored by the optical fiber are displayed on the display device 17-2 at a same position with respect to the burner arrangement in the boiler so that the combustion conditions of each burner in the boiler can be displayed having a similar positional relation to the burner arrangement. To this end, the output ends of optical fibers provided for the burners are held in position, as shown in detail in FIGS. 6A and 6B, by a holder 18 so as to take corresponding positions to the stage and column positions of the burners. The outputs of the optical fibers are passed through an optical system including an objective lens 20 and an eyepiece 19 and thereafter, converted into electrical signals by an ITV camera 11'. The output from the ITV camera 11' is converted into a digital signal by an A/D converter 13' and stored in a storage device 14' to be inputted to a processor 16.

Figure 7:
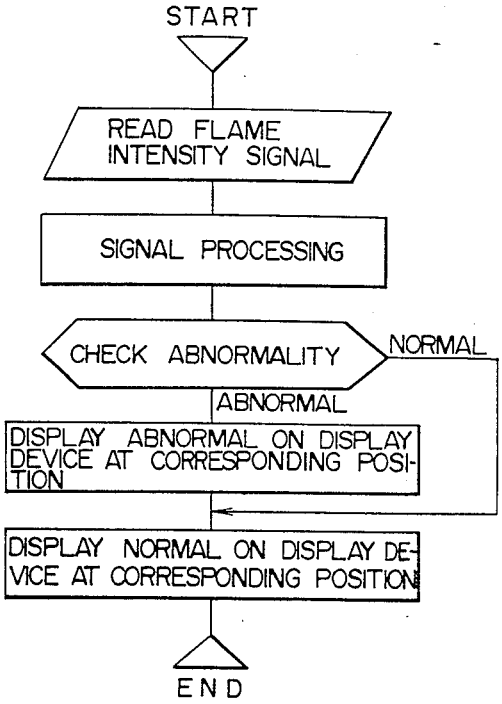
FIG. 7 is a flow chart showing the processes by the embodiment shown in FIG. 5.
Figure 8:
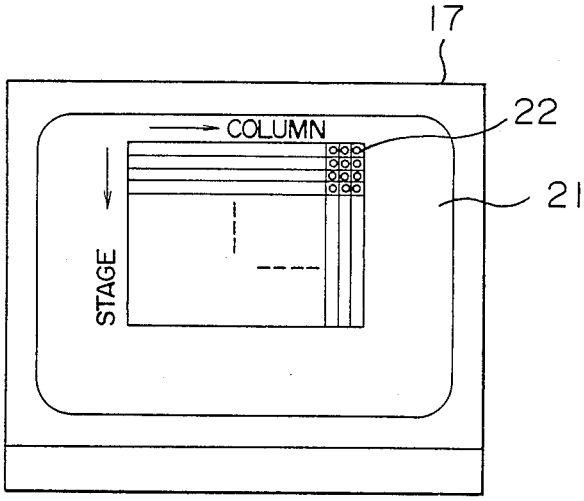
FIG. 8 shows an example of a display screen of the embodiment shown in FIG. 5.

The flow chart illustrating the processes by the processor 16 is shown in FIG. 7. Particularly, a signal representative of the flame intensity of each burner monitored by the optical fiber is read from the storage device 14' to be processed in a similar manner to that shown with FIG. 4B such that whether the signal is within a predetermined range or not is indicated using a binary signal, e.g., "1" and "0". Whether the combustion conditions of a burner are normal or not is judged based on the binary signal, and the judged results are displayed on the display device 17-2. Whether the flame light-intensity signal obtained from the optical burner at each burner is normal or not, is displayed on the display device 17-2 at a position corresponding to that of the burner concerned. Such display indicates a positional pattern of the combustion conditions of the burners in the boiler, so that the combustion conditions of the burners can be easily judged at a glance. The display on the display device may use different colors, characters or numerals, depending on the normal and abnormal conditions. FIG. 8 shows an example of a display device, wherein reference numeral 21 represents a display screen, and reference numeral 22 represents a position of the burner combustion conditions to be displayed. In this embodiment, since the combution conditions of all the burners are displayed on the display device with the same positional relation to the burner arrangement in the boiler, monitoring a multi-burner boiler can be carried out more easily.

Instead of a binarizing process of an optical fiber output signal, a three-value process may be used which determines if an optical fiber output is within a predetermined range, larger or smaller than the predetermined range. In this case, the pattern of the combustion conditions of the burners in the boiler can be recognized more correctly.

Figure 6A:
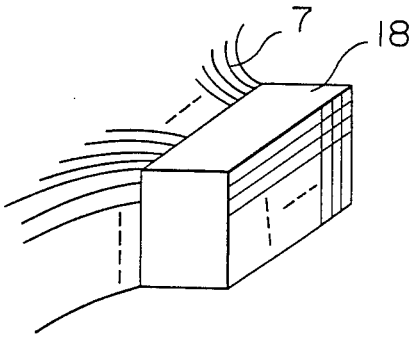
FIGS. 6A and 6B are schematic views showing the configuration of optical fibers.
Figure 6B:
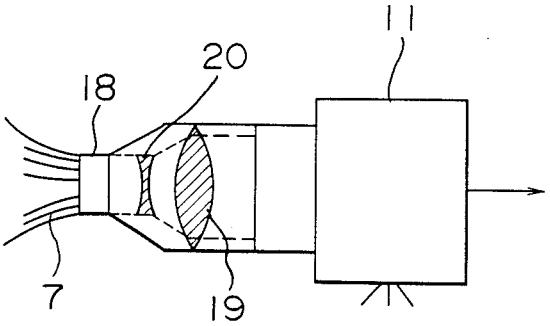

A display as shown in FIG. 8 using the optical fiber holder and the optical system shown in FIGS. 6A and 6B can be effectively applied to the case where only an optical fiber is provided for each burner as described with the first embodiment of this invention.

We claim:

1. A method for monitoring the combustion conditions in a furnace of a boiler having at least one group of burners, comprising the steps of:

providing an image fiber for one of the burners of each group, and obtaining a flame image representative of the flame condition of said one burner;

detecting the light intensity at a predetermined area of a flame of each of the burners other than said one burner in each group, by using an optical fiber provided to said other burners so as to view said predetermined area of the flame thereof;

estimating a normal range of the light-intensity of a flame of each of the other burners under a normal combustion of the burner, based on said flame image;

judging whether the combustion condition of each burner is normal or not, based on whether the light intensity of a flame of the burner at said predetermined area obtained by said optical fiber is within said estimated normal range; and displaying said judgement results.

2. A method for monitoring according to claim 1, wherein said normal range of the light-intensity is a range within which a deviation of the light-intensity from an average light-intensity at an area of the flame image corresponding to the view of the optical fiber is smaller than a predetermined value.

3. A method for monitoring according to claim 1, wherein said normal range of the light-intensity is defined by a function of an average light-intensity at an area of the flame image corresponding to the view of the optical fiber state associated with said flame image.

4. A method for monitoring according to claim 1, wherein said normal range of the light-intensity is defined by a function of a light-intensity at a predetermined position of the flame image.

5. A method for monitoring according to claim 1, wherein said judgement results are displayed by display elements disposed correspondingly to positions of the burners in said furnace.

* * * * *